US005267538A

United States Patent [19]

Speil et al.

[11] Patent Number: 5,267,538

[45] Date of Patent: Dec. 7, 1993

[54] MECHANICAL VALVE TAPPET FOR AN INTERNAL COMBUSTION ENGINE

[75] Inventors: Walter Speil, Ingolstadt; Dieter Schmidt, Nuremberg; Michael Zipprath, Weisendorf, all of Fed. Rep. of Germany

[73] Assignee: INA Walzlager Schaeffler KG, Fed. Rep. of Germany

[21] Appl. No.: 894,118

[22] Filed: Jun. 5, 1992

[30] Foreign Application Priority Data

Jun. 7, 1991 [DE] Fed. Rep. of Germany ..... 4118776

[51] Int. Cl.[5] ..... F01L 1/14

[52] U.S. Cl. ..... 123/90.48; 29/888.43

[58] Field of Search ..... 123/90.48, 90.49, 90.50, 123/90.15; 29/888.43

[56] References Cited

U.S. PATENT DOCUMENTS 4,615,309 10/1986 Yoshikawa ..... 123/90.48
5,081,976 1/1992 Dahm et al. ..... 123/90.48
5,129,372 7/1992 Seiberth ..... 123/90.48

FOREIGN PATENT DOCUMENTS 0334064 9/1989 European Pat. Off. ..... 123/90.48
0396288 11/1990 European Pat. Off. ..... 123/90.48
3919777 6/1990 Fed. Rep. of Germany ... 123/90.48
4014578 11/1991 Fed. Rep. of Germany ... 123/90.48

*Primary Examiner*—Tony M. Argenbright
*Assistant Examiner*—M. Macy
*Attorney, Agent, or Firm*—Bierman & Muserlian

[57] ABSTRACT

A mechanical valve tappet arranged in a guide bore of a cylinder head of an internal combustion engine, which valve tappet comprises a cup-shaped housing with a hollow cylindrical wall (1) closed at one end by a bottom (2) against which a control cam runs from the outside while an adjusting element (5) bears against the inner surface of the bottom by a first flat end face and is in contact with the end of a valve stem of a two-way gas valve by a second end face which is parallel to said first end face, characterized in that the adjusting element (5) is a solid component with a cylindrical outer peripheral surface and parallel end faces, projections being provided on the cup-shaped housing to cooperate with the cylindrical outer peripheral surface of the adjusting element so that the adjusting element (5) is retained by interlocking or by force engagement on the cup-shaped housing.

11 Claims, 3 Drawing Sheets

MECHANICAL VALVE TAPPET FOR AN INTERNAL COMBUSTION ENGINE

STATE OF THE ART

Mechanical valve tappets arranged in a guide bore of a cylinder head of an internal combustion engine, which valve tappets comprise a cup-shaped housing with a hollow cylindrical wall closed at one end by a bottom against which a control cam runs from the outside while an adjusting element bears against the inner surface of the bottom by a first flat end face and is in contact with the end of a valve stem of a two-way gas valve by a second end face which is parallel to said first end face are known. In these, an adjusting disc is arranged between the inner surface of the bottom of the cup-shaped housing and the end of the valve stem of a two-way gas valve. For the retention of the adjusting disc, either a specially shaped valve spring retainer has to be provided on the valve stem, or the adjusting disc has to be made cup-shaped to enable it to engage with the end of the valve stem. In both cases, the adjusting disc is a separate member which necessitates a special work step during engine assembly.

OBJECTS OF THE INVENTION

It is an object of the invention to provide a valve tappet which, together with a replaceable adjusting element, forms a single mounting unit.

This and other objects and advantages of the invention will become the following detailed description.

THE INVENTION

The mechanical valve tappet of the invention arranged in a guide bore of a cylinder head of an internal combustion engine, which valve tappet comprises a cup-shaped housing with a hollow cylindrical wall (1) closed at one end by a bottom (2) against which a control cam runs from the outside while an adjusting element (5) bears against the inner surface of the bottom by a first flat end face and is in contact with the end of a valve stem of a two-way gas valve by a second end face which is parallel to said first end face, is characterized in that the adjusting element (5) is a solid component with a cylindrical outer peripheral surface and parallel end faces, projections being provided on the cup-shaped housing to cooperate with a cylindrical outer peripheral surface of the adjusting element so that the adjusting element (5) is retained by interlocking or by force engagement on the cup-shaped housing.

Since the adjusting element is a solid component with a cylindrical outer peripheral surface and parallel end faces, and projections are provided on the cup-shaped housing to cooperate with the cylindrical outer peripheral surface of the adjusting element so that the latter is retained by interlocking or by force engagement on the cup-shaped housing, it is possible to stock adjusting elements of different assorted lengths to be stocked, which are assembled with the valve tapped prior to engine assembly to form a single mounting unit.

Referring now to the drawings.

Figure 1:
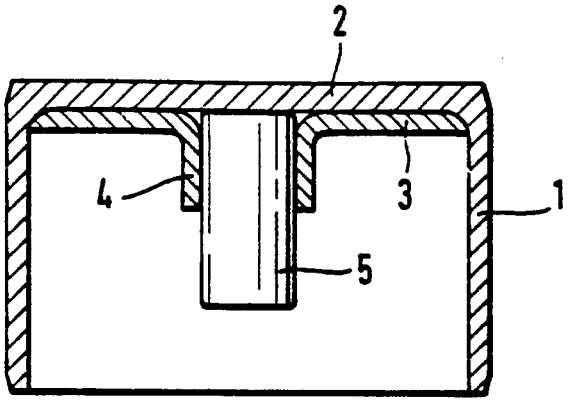
FIGS. 1 to 8 are longitudinal cross-sections through different embodiments of the mechanical valve tappets of the invention.

The valve tappet of FIG. 1 comprises a hollow cylindrical wall (1) which is closed at its upper end by bottom (2) against which during operation a control cam runs. Inside the tappet, disc (3) bears against the bottom (2) and is shaped into a hub (4) at its center. The hub (4) receives the adjusting element (5) which is retained there under radial pre-tension.

Figure 2:
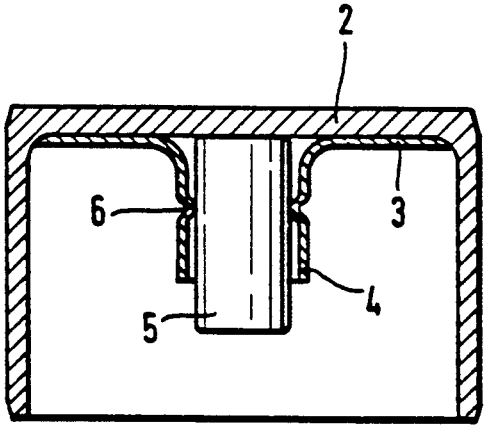
Figure 3:
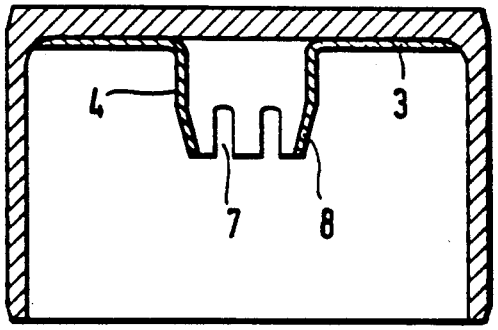

The embodiment of FIG. 2 differs from that of FIG. 1 by the fact that the hub (4) comprises several radially inwards directed knobs 6 on its periphery which bear with pre-tension against the adjusting element (5). According to FIG. 3, the end of the hub (4) is provided with several longitudinal slits (7) resulting in the formation of resilient tongues (8) which retain the adjusting element, not shown in this figure, by force engagement.

Figure 4:
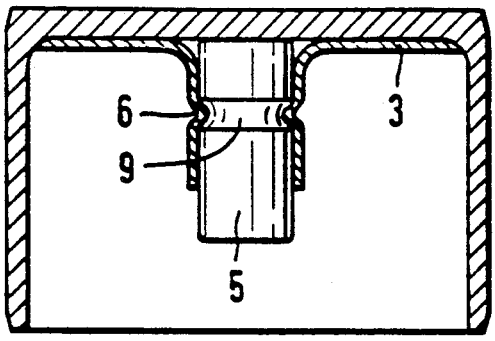
Figure 5:
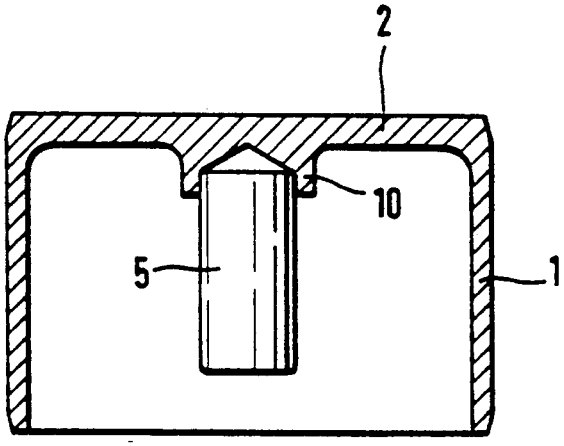

The embodiment of FIG. 4 resembles that of FIG. 2 except for the fact that the knobs 6 engage into a peripheral groove 9 of the adjusting element (5), thus effecting a retention of the adjusting element (5) by interlocking. In the construction shown in FIG. 5, a hub (10) is formed in one piece with the bottom (2) and engages likewise under pre-tension around the adjusting element (5).

Figure 6:
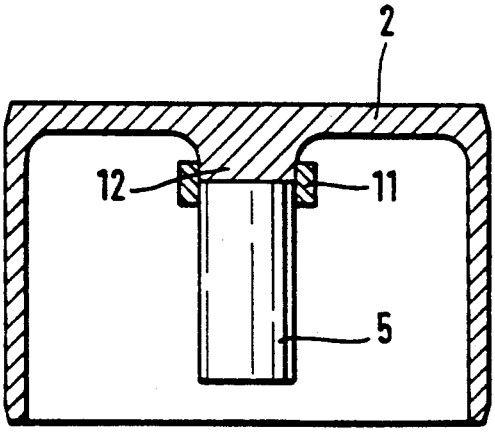
Figure 7:
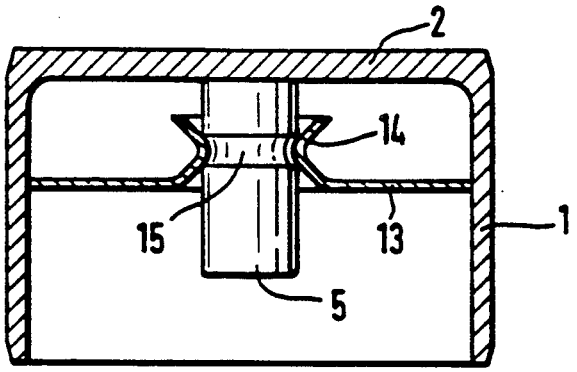

According to FIG. 6, the hub which retains the adjusting element under pre-tension is formed by a separate hollow cylindrical component (11) which in its turn is fitted under pre-tension onto a cylindrical projection made in one piece with the bottom (2). FIG. 7 shows an embodiment in which a disc (13) which is joined to the hollow cylindrical wall 1 at a distance from the bottom (2), comprises a neck (14) at its center which interlocks with a groove (15) of the adjusting element (5).

Figure 8:
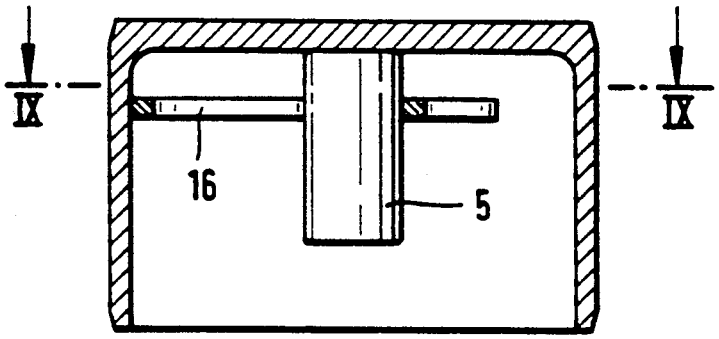
Figure 9:
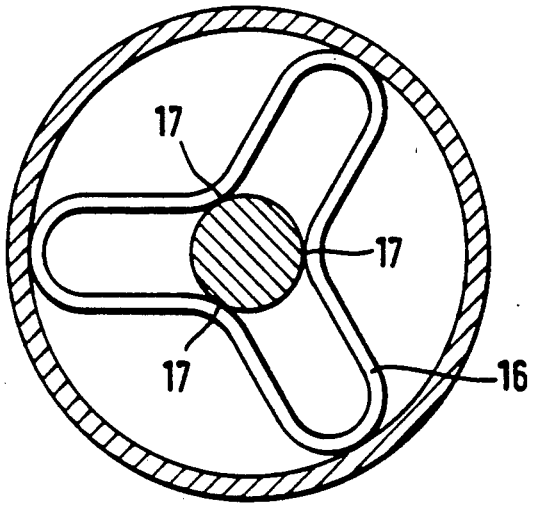
FIG. 9 is a cross-section of the valve tappet of FIG. 8 taken along line IX—IX.

Finally, FIGS. 8 and 9 show an embodiment in which a resilient component (16) is provided in the bore of the hollow cylindrical wall and bears under pre-tension at three points 17 against the adjusting element (5), thus holding the latter in position. Methods of fixing the disc (3 or 13) and the resilient component (16) on the valve tappet have intentionally not been shown in the drawings because all conceivable joining methods like, for instance welding, soldering, gluing or stamping by non-chipping deformation can be used for this purpose.

Various modifications of the valve tappet of the invention may be made without departing from the spirit or scope thereof and it is to be understood that the invention is intended to be limited only as defined in the appended claims.

What is claimed is:

1. A mechanical valve tappet arranged in a guide bore of a cylinder head of an internal combustion engine, which valve tappet comprises a cup-shaped housing with a hollow cylindrical wall (1) closed at one end by a bottom (2) against which a control cam runs from the outside while an adjusting element (5) bears against the inner surface of the bottom by a first flat end face and is in contact with the and of a valve stem of a two-way gas valve by a second end face which is parallel to said first end face, characterized in that the adjusting element (5) is a slid component with a cylindrical outer peripheral surface and parallel end faces, a hub (4) concentric with the hollow cylindrical wall (1) is arranged inside the cup-shaped housing and comprises a bore whose diameter corresponds approximately to the outer diameter of the adjusting element (5), and the adjusting element (5) is retained on the cup-shaped housing by interlocking or by force engagement without allowing axial movement of the adjusting element in the bore of the hub (4).

2. A valve tappet of claim 1 wherein the bore diameter of the hub (4) is adapted to the outer diameter of the adjusting element (5) so that pre-tension exists between the hub (4) and the adjusting element (5).

3. A valve tappet of claim 2 wherein inwards protruding knobs (6) are formed at some peripheral points of the hub (4) which bear under elastic pre-tension against the outer peripheral surface of the adjusting element (5).

4. A valve tappet of claim 1 wherein the hub (4) is divided into resilient tongues (8) over a part of its length by longitudinal slits (7), and the tongues (8) bear under pre-tension against the outer peripheral surface of the adjusting element (5).

5. A valve tappet of claim 1 wherein the hub (4) comprises resilient projections (6) which interlock with corresponding recesses (9) on the outer peripheral surface of the adjusting element (5).

6. A valve tappet of claim 1 wherein the hub (10) is formed as a projection in one piece with the bottom (2).

7. A valve tappet of claim 1 wherein the hub (4) is a sheet metal or plastic element which at one axial end merges into a disc (3,13) which extends at least approximately radially and is secured at its outer edge to the hollow cylindrical wall (1).

8. A valve tappet of claim 1 wherein the hub (4) is a separate hollow cylindrical component (11) which is fixed at one of its axial ends on the inner surface of the bottom (2).

9. A valve tappet of claim 1 wherein the bottom (2) comprises a cylindrical projection (12) onto which the hub is pressed.

10. A valve tappet of claim 1 wherein several leaf springs spaced around the periphery are arranged within the hollow cylindrical wall (1), which leaf springs bear by their ends against the hollow cylindrical wall and in their intermediate regions are bent towards the center of the tappet so that they bear against the outer peripheral surface of the adjusting element under elastic pre-tension.

11. A valve tappet of claim 10 wherein the several leaf springs together form a one-piece component (16).

* * * * *